US009737125B2

(12) United States Patent
Sabbatini

(10) Patent No.: US 9,737,125 B2
(45) Date of Patent: Aug. 22, 2017

(54) ELECTRIC HAIRDRYER WITH A MOTOR PROTECTING DEVICE

(71) Applicant: ELCHIM S.P.A., Milan (IT)

(72) Inventor: Roberto Sabbatini, Milan (IT)

(73) Assignee: ELCHIM S.P.A., Milan (IT)

( * ) Notice: Subject to any disclaimer, the term of this patent is extended or adjusted under 35 U.S.C. 154(b) by 0 days.

(21) Appl. No.: 14/841,537

(22) Filed: Aug. 31, 2015

(65) Prior Publication Data

US 2016/0206073 A1 Jul. 21, 2016

(30) Foreign Application Priority Data

Jan. 16, 2015 (IT) ..... MI150008 U

(51) Int. Cl.
*A45D 20/12* (2006.01)

(52) U.S. Cl.
CPC ..... *A45D 20/12* (2013.01)

(58) Field of Classification Search
CPC A45D 20/00; A45D 20/12; F26B 5/00; F26B 5/06; F04D 17/00
USPC ..... 34/96, 97, 98, 99, 100; 417/423.14, 244
See application file for complete search history.

(56) References Cited

U.S. PATENT DOCUMENTS 2,012,473 A * 8/1935 McElroy ..... A45D 20/22 248/161
2,432,067 A * 12/1947 Morse ..... A45D 20/10 200/11 EA
2,502,207 A * 3/1950 Curley ..... F04D 29/526 417/423.1
3,836,749 A * 9/1974 Hubner ..... H05B 3/16 338/302
4,118,874 A * 10/1978 Morane ..... A45D 20/34 34/100
5,749,702 A * 5/1998 Datta ..... F04D 29/664 415/119
5,875,562 A * 3/1999 Fogarty ..... A45D 20/10 34/97
6,269,549 B1 * 8/2001 Carlucci ..... A45D 20/22 34/100
8,434,238 B2 * 5/2013 Gross ..... A45D 20/12 132/212
2006/0096118 A1 * 5/2006 Ward ..... F26B 21/001 34/487
2016/0206073 A1 * 7/2016 Sabbatini ..... A45D 20/12

FOREIGN PATENT DOCUMENTS

GB WO 9616301 A1 * 5/1996 ..... A45D 20/10
GB 2503519 A * 1/2014 ..... A45D 20/10
IT EP 1438907 A1 * 7/2004 ..... A45D 1/00
JP EP 1704792 A1 * 9/2006 ..... A45D 20/12
(Continued)

*Primary Examiner* — Stephen M Gravini
(74) *Attorney, Agent, or Firm* — Hedman & Costigan, P.C.; James V. Costigan; Kathleen A. Costigan

(57) ABSTRACT

An electric hairdryer comprises an electric motor, having an electric motor shaft, on which an air fan is assembled, said hairdryer comprising moreover an electric motor protecting device including a tapering body arranged between the electric motor and the air fan, and so designed as to hold therein an electric fan impeller hub, at a base portion of said electric fan, and to prevent a clearance from forming between the motor shaft bushing or ball bearing and the air fan.

10 Claims, 4 Drawing Sheets

(56) References Cited

FOREIGN PATENT DOCUMENTS

| | | | | | |
|---|---|---|---|---|---|
| JP | EP 2874285 | A3 * | 12/2015 | ..... | H02K 11/0073 |
| JP | DE 102016200012 | A1 * | 7/2016 | ..... | A45D 20/12 |
| JP | EP 3047751 | A1 * | 7/2016 | ..... | A45D 20/12 |

* cited by examiner

ELECTRIC HAIRDRYER WITH A MOTOR PROTECTING DEVICE

BACKGROUND OF THE INVENTION

The present invention relates to an electric hairdryer including a protecting device for protecting the hairdryer electric motor.

As is known, a hairdryer comprises an electric motor which drives a fan sucking air from an air inlet and conveys the sucked air toward heating means so that it is delivered in a hot condition.

The air inlet comprises a mesh filter preventing hair from being sucked in the hairdryer and entwined round the motor shaft, with a risk of locking the motor because of mechanical friction and bushing oil absorption by the hair mass.

In prior hairdryers, hair passing the air filter is sucked by the fan face negative pressure and, if hair has a long length, is easily twisted round the motor shaft, thereby causing a hairdryer failure.

The above drawback has been overcome, in addition to performing an accurate maintenance and cleaning operation, by hairdryer sucking bodies and fans of complex constructions, or hairdryers including electric motor supporting elements with fan protecting components.

However, the above measures involve a great increase of the hairdryer weight and a reduction of the air flow rate, and do not efficiently solve the twisted hair problem.

For overcoming the above drawback, prior art hairdryers also comprise small protecting caps, either fully or partially encompassing the motor, on which are mounted the fan blades, which solution, however, negatively affects the hairdryer efficiency.

SUMMARY OF THE INVENTION

Accordingly, the aim of the present invention is to provide an electric hairdryer including a protecting system or device efficiently preventing hair from twisting round the electric motor shaft.

Within the scope of the above mentioned aim, a main object of the invention is to provide such a hairdryer including a protecting device of very simple and efficient construction.

Another object of the present invention is to provide such a hairdryer with a protecting device which is also adapted for a high speed centrifugal air fan professional hairdryer preventing the hair filter from restraining hair even if said filter is provided with a filter protecting mesh.

Yet another object of the present invention is to provide a hairdryer with a protecting device adapted to be operated by different electric motors, e.g. an AC, a brushless or a DC electric motor.

Yet another object of the present invention is to provide a hairdryer which is very reliable and safe in operation.

According to one aspect of the present invention, the above mentioned aim and objects, as well as yet other objects, which will become more apparent hereinafter, are achieved by an electric hairdryer including a hairdryer electric motor having a motor shaft operating an air fan, wherein said hairdryer comprises moreover an electric motor protecting device including a tapering body, arranged between the electric motor and fan, and designed to hold therein a fan impeller hub, at a base portion of said fan, and to prevent a clearance from forming between the motor shaft bushing or ball bearing, and the hairdryer fan.

BRIEF DESCRIPTION OF THE DRAWINGS

Further characteristics and advantages of the present invention will become more apparent hereinafter from the following detailed disclosure of a preferred, though not exclusive, embodiment of the invention which is illustrated, by way of an indicative but not limitative example, in the accompanying drawings, where.

DESCRIPTION OF THE PREFERRED EMBODIMENTS

Figure 1:
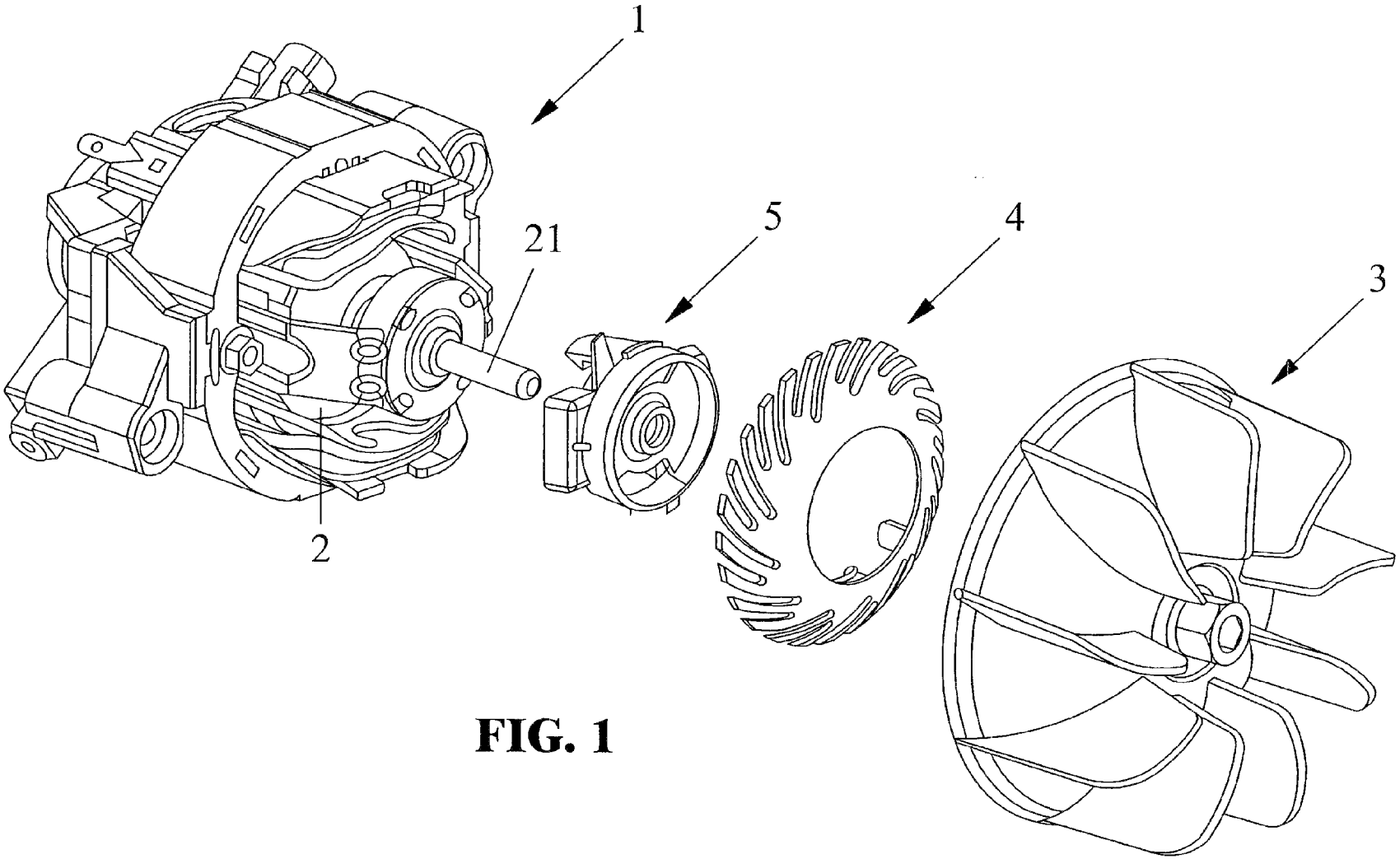
FIG. 1 is an exploded perspective view of an AC or brushless motor assembly, with a related air fan, and including the protecting device according to the present invention.

With reference to the number references of the above mentioned figures, the electric hairdryer according to the present invention, which has been generally indicated by the reference number 1, comprises a hairdryer assembly including an electric motor 2 having an electric motor shaft 21 on which an air fan 3 is assembled.

According to the present invention, the hairdryer further comprises an electric motor protecting device, having a tapering or bevel body 4, arranged between the electric motor and the air fan, so designed as to hold therewithin the hub of the air fan 3 impeller, at the base portion of said air fan, and to prevent a clearance between the motor shaft 21 bushing or ball bearing and the air fan from forming.

The tapering body 4 advantageously comprises cut-outs or notches 41, preferably arranged on an edge thereof, cooperating for preventing hair from twisting round the motor shaft, while favoring a distribution of hair within the hairdryer, which hair would otherwise negatively affect a proper operation of the hairdryer electric motor.

FIG. 1 shows the hairdryer including an AC or a brushless motor.

Figure 2:
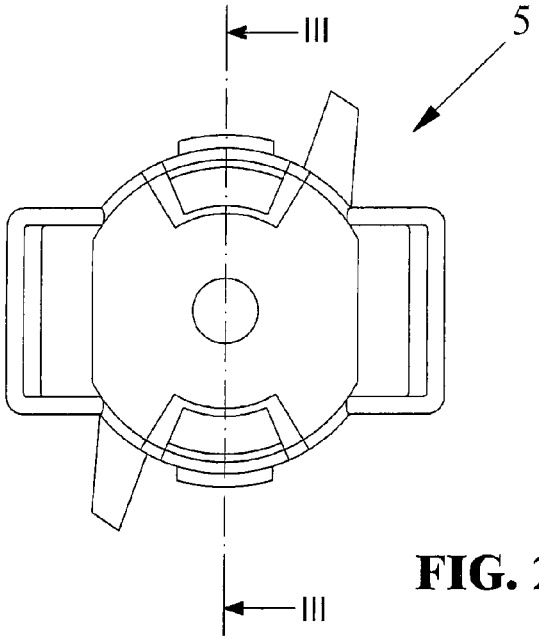
FIG. 2 is a front view of a cylindric body of the protecting device.
Figure 3:
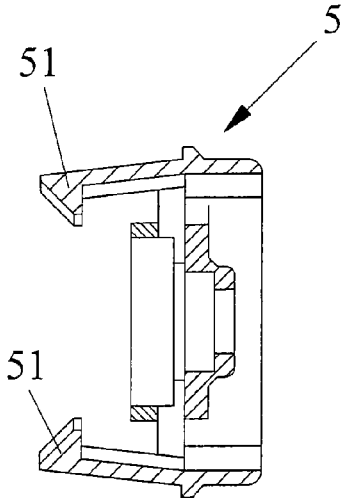
FIG. 3 is a cross-sectional view of the protecting device cylindric body of FIG. 2.
Figure 4:
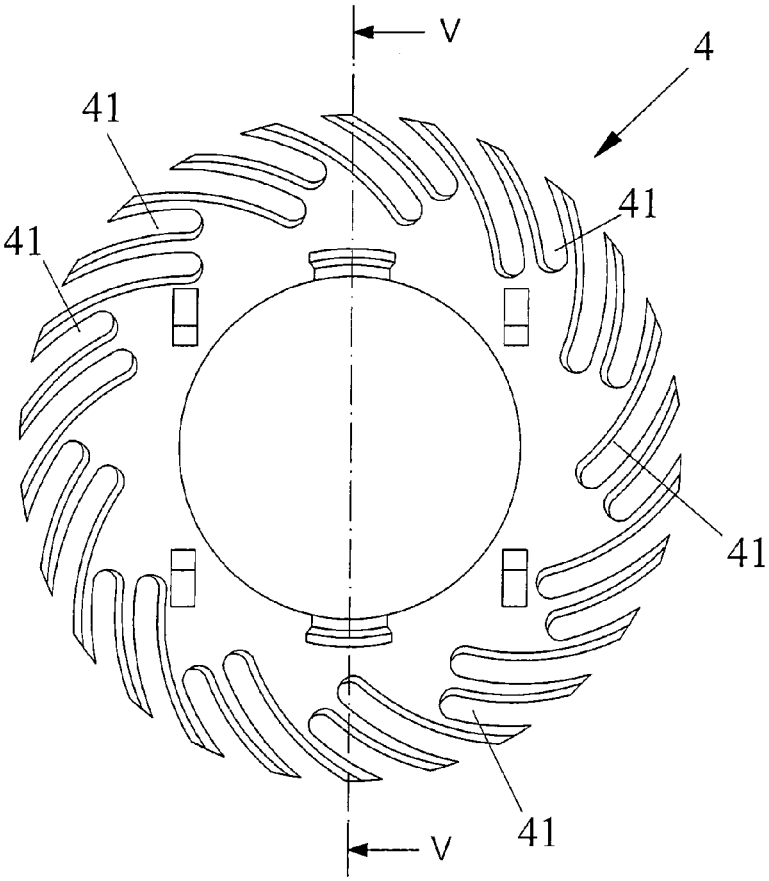
FIG. 4 is a front view of a tapering body of the protecting device.
Figure 5:
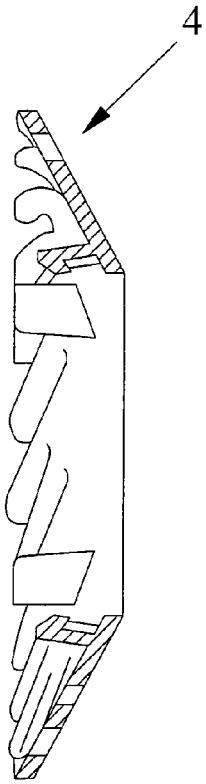
FIG. 5 is a cross-sectional view of the tapering body shown in FIG. 4.

Advantageously, the protecting device comprises in this case a cylindric body 5 as shown in FIGS. 1-3.

The cylindric body 5 comprises latching elements 51 to properly latch or lock the cylindric body 5 to the electric motor 2.

The cylindric body 5 operates as a support for the tapering body 4, which is made integral or rigid with the electric motor while protecting, by encompassing the fan impeller hub, the motor shaft 21 from hair entering the hairdryer.

In this connection it should be pointed out that the cylindric body 5 and the tapering body 4 may be made as a single piece.

Figure 6:
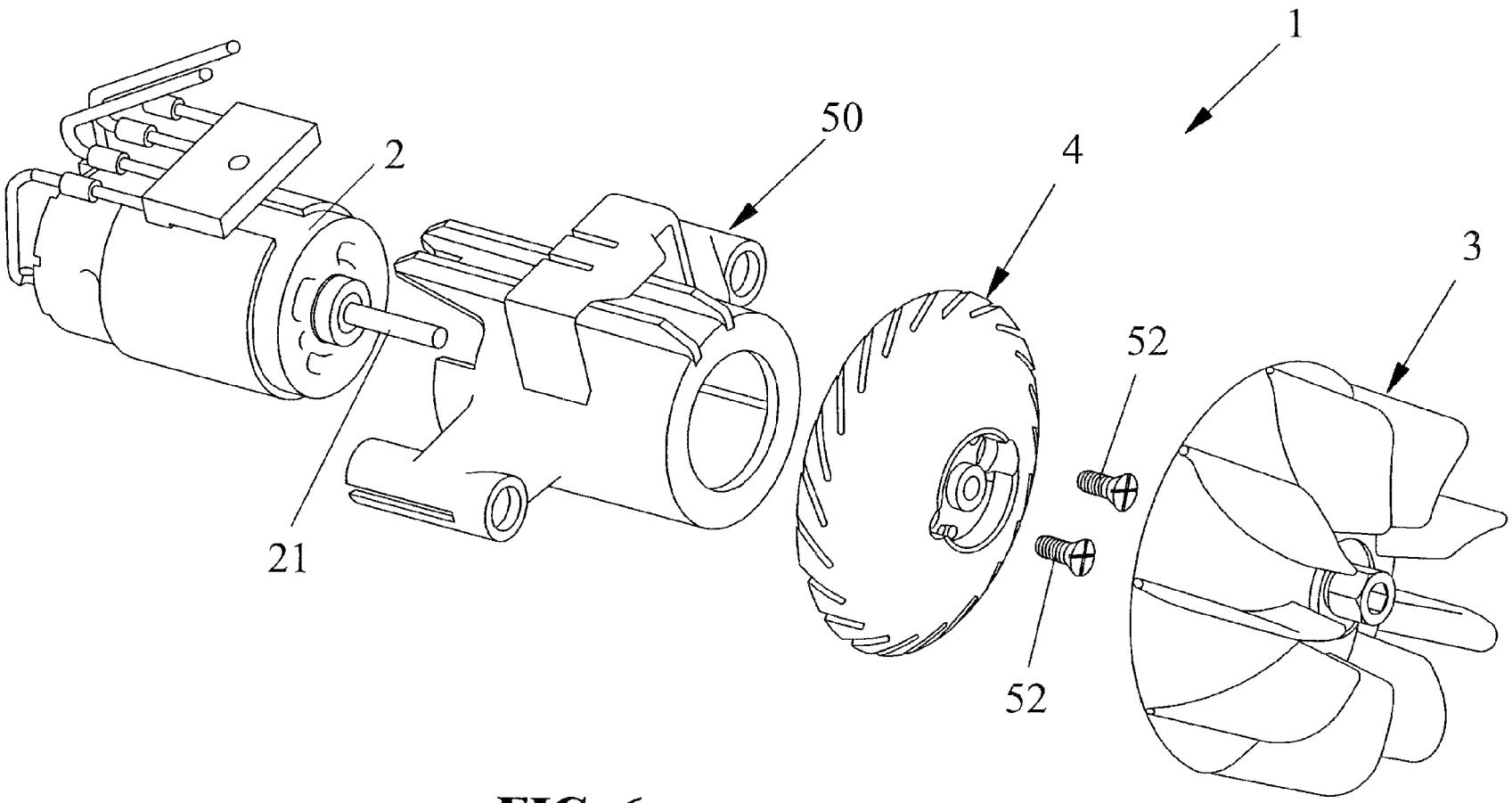
FIG. 6 is an exploded perspective view of a DC motor assembly and an air fan, including the protecting device according to the present invention.
Figure 7:
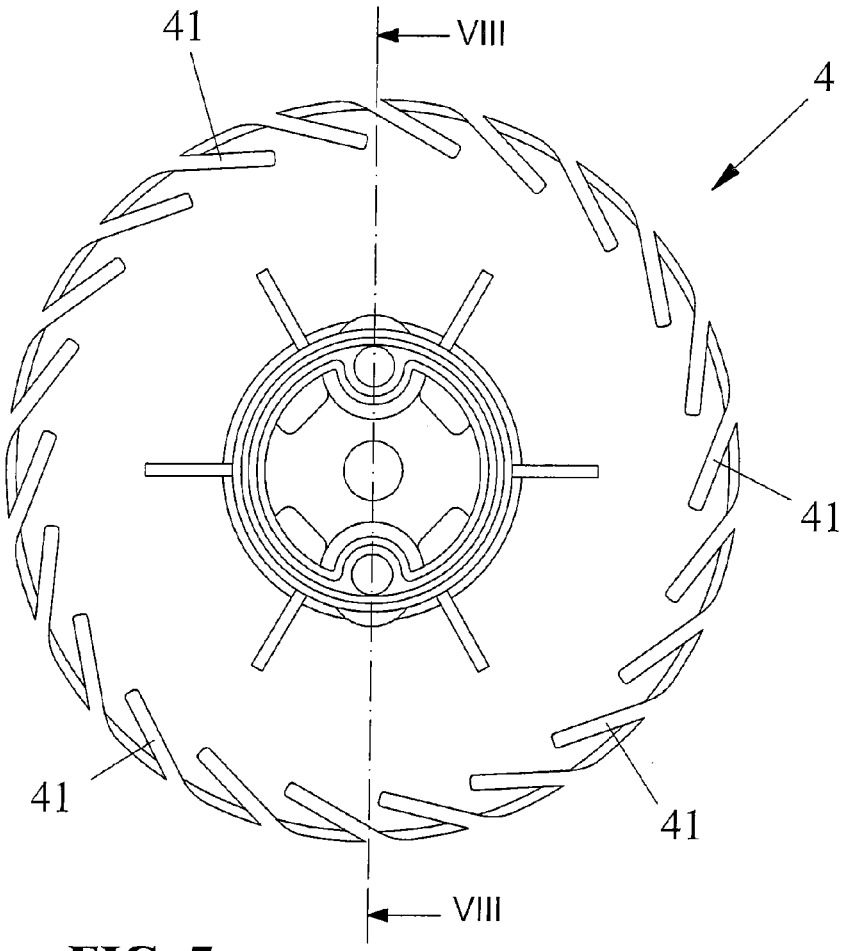
FIG. 7 is a front view of the protecting device tapering body of FIG. 6.
Figure 8:
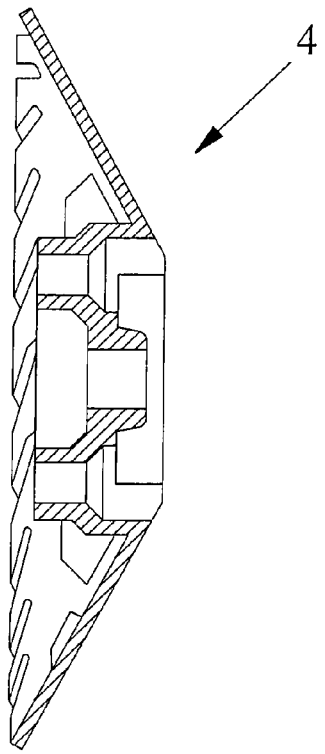
FIG. 8 is a cross-sectional view of the tapering body of FIG. 7.

FIG. 6 shows a hairdryer including a DC motor having an encompassing support element 50 on which the tapering body 4 is mounted, for example by mounting screws 52.

The protecting device according to the present invention prevents hair from twisting round the motor shaft, thereby preventing failures of the electric motor and increasing the operating life thereof.

The tapering body 4 properly protects the motor shaft by encompassing the impeller hub, at the base portion of the air fan, and the top portion of the electric motor.

The protecting device may be advantageously made of any desired plastics material or any other suitable materials.

Moreover, the protecting device and, in particular, its "tapering" body may be so designed as to perfectly fit any desired type of air fans, by providing the air fan impeller hub with a clutch-in configuration.

The present invention may be applied both to an electric motor including an impeller mounted on a bushing, or to an electric motor including an impeller mounted on a ball bearing.

In both cases, the protecting device is so assembled as to prevent any clearance between the motor shaft and the fan from forming.

It has been found that the invention fully achieves the intended aim and objects.

In fact, the invention has provided a hairdryer including a protecting device which, as arranged between the fan and the motor, prevents hair sucked into the hairdryer from twisting round the motor shaft, thereby in turn preventing any failure of the electric motor because of a mechanical friction and bushing oil absorption by the hair mass.

The hairdryer according to the invention is particularly advantageous for professional hairdresser hairdryers including high speed centrifugal fans which would facilitate an inlet of hair through the hairdryer filter, notwithstanding the provision of the filter protecting mesh.

On the other hand, the inventive hairdryer may also be used in home applications, and with any desired types of air fans.

In practicing the invention, the hairdryer materials and size may be any, according to requirements.

The invention claimed is:

1. An electric hairdryer including an electric hairdryer electric motor having an electric motor shaft, on which an air fan is mounted, said hairdryer further comprising an electric motor protecting device including a tapering body arranged between the electric motor and the air fan, to hold therein an impeller hub of said air fan, at a base portion of said air fan, and said protecting device further comprising an encompassing support that supports said tapering body and that is attached to a motor shaft bushing or a ball bearing of said electric motor, said encompassing support being arranged between said tapering body and said motor shaft bushing or said ball bearing such as to prevent a clearance from forming on said electric motor shaft between said motor shaft bushing or said ball bearing and said air fan and to protect said electric motor shaft from hair entering the hairdryer.

2. A hairdryer, according to claim 1, characterized in that said tapering body comprises a plurality of substantially radially extending cut-outs, preventing hair from twisting round the motor shaft, while favoring a distribution of said hair within the hairdryer, and preventing hair from causing a failure of the electric motor.

3. A hairdryer, according to claim 1, characterized in that said electric motor is of an AC or brushless type.

4. A hairdryer, according to claim 1, characterized in that said encompassing support of said protecting device comprises a cylindrical body including latching elements to latch said cylindrical body to said electric motor; said cylindrical body operating as a support for the tapering body rigid with said electric motor while protecting, by encompassing the air fan impeller hub, the motor shaft from hair susceptible to enter the hairdryer.

5. A hairdryer, according to claim 4, characterized in that said cylindrical body and said tapering body are made as a single piece.

6. A hairdryer, according to claim 1, characterized in that said electric motor is a DC electric motor.

7. A hairdryer, according to claim 6, characterized in that said encompassing support comprises an encompassing support element on which the tapering body is mounted and which is mounted on said DC electric motor.

8. A hairdryer, according to claim 1, characterized in that said protecting device is made of a plastics material.

9. A hairdryer, according to claim 1, characterized in that said protecting device tapering body is so designed as to fit any desired air fans, by forming the air fan impeller hub with a clutch-in configuration.

10. A hairdryer, according to claim 1, characterized in that said protecting device may be applied either to an electric motor shaft including an air impeller or fan mounted on said bushing, or to an electric motor shaft including said ball bearing.

* * * * *